United States Patent [19]

Sheffer

[11] Patent Number: 4,736,537

[45] Date of Patent: Apr. 12, 1988

[54] DECORATIVE OR ADVERTISING INSERT FOR SHELVING UNITS

[75] Inventor: Phil B. Sheffer, New Oxford, Pa.

[73] Assignee: Merchandising Innovations Co., Hanover, Pa.

[21] Appl. No.: 825,606

[22] Filed: Feb. 3, 1986

[51] Int. Cl.[4] ..... G09F 1/00

[52] U.S. Cl. ..... 40/124.1; 40/610

[58] Field of Search ..... 40/124.1, 584, 16 R, 40/20 R, 120, 124

[56] References Cited

U.S. PATENT DOCUMENTS

| | | | |
|---|---|---|---|
| 1,809,688 | 6/1931 | Goudey et al. | 40/124.1 |
| 1,953,673 | 4/1934 | Davidson | 40/124.1 |
| 3,256,628 | 6/1966 | Green | 40/124.1 |
| 3,534,491 | 10/1970 | Girard | 40/124.1 |
| 4,266,355 | 5/1981 | Moss | 40/124.1 |

*Primary Examiner*—Robert Peshock
*Assistant Examiner*—Wenceslao J. Contreras
*Attorney, Agent, or Firm*—Daniel J. O'Connor

[57] ABSTRACT

A foldable corrugated fiberboard decorative insert which is intended for use in the enhancement of the appearance of a bookshelving unit and also for use as a general advertising means. The invention inherently includes a novel method of display advertising which may be effectively utilized by retail merchants without the need for costly expenditures for complex advertising display systems. The invention structure is designed to be shipped in a flat or knockdown position so that multiple units may be most economically shipped and warehoused as needed.

1 Claim, 1 Drawing Sheet

DECORATIVE OR ADVERTISING INSERT FOR SHELVING UNITS

BACKGROUND AND OBJECTS OF THE INVENTION

This invention relates generally to a method and apparatus for advertising and enhancing the decorative aspects of bookshelving units.

The need for effective point of purchase advertising systems is well recognized in the merchandising arts. It is also known in the retail arts that if a product, such as a shelving unit, can be shown to have a particular utility for a prospective purchaser then sales of the product will be greatly increased.

Thus, in the prior art, various complex advertising displays have been developed. One significant problem encountered in the prior art is the time required to assemble and display advertising systems. Many systems are thus rendered unusable since the retail merchant cannot expend the time or labor costs to utilize the many advertising displays sent to him.

Another limiting factor in prior art advertising displays is that of space, i.e. retail merchants typically desire to use all available floor space to show the products sold. Advertising displays which reduce the product display area are thus undesirable for most retail merchants.

It is also highly important that product advertising displays be stable so that the risk of injury to shoppers and to property is minimized.

Accordingly, it is an object of the present invention to provide a decorative insert for a bookshelf or an advertising display which may be readily assembled and used by a retail merchant or by persons unfamiliar with display assembly techniques.

It is a further object of the invention to provide a display insert which does not reduce available floor space in a retail area.

It is another object to provide a display insert whereby multiple units may be shipped in a flat or knockdown position to reduce transportation and warehousing costs and wherein the display units are made of a light-weight material to further reduce shipping costs.

It is a still further object to provide a display insert which is highly stable in use to reduce the risk of injury to retail shoppers and property.

It is another object of the invention to provide a display insert which is closely and physically associated with the product sold to thereby increase product sales.

It is a further object to provide a display insert which is of a decorative and attractive appearance and which may be, if desired, left in place by the purchaser as a designation of particular household items, e.g. children's toys or books.

It is a further object to provide a decorative insert which is structurally designed and engineered so that it may be used for extended periods by merchants or purchasers without a risk of deterioration upon such extended use.

Further objects and advantages of the present invention will become apparent as the following description proceeds, and the features of novelty characterizing the invention will be pointed out with particularity in the claims annexed to and forming a part of this specification.

PRIOR ART PATENTS

The prior art patents which are presently known by the inventor to be related to the present invention are as follows: U.S. Pat. No. 3,532,310 issued to Finfrock on Oct. 6, 1970 and U.S. Pat. No. 3,032,905 issued to Schultz on May 8, 1962.

The U.S. Pat. No. 3,532,310 issued to Finfrock illustrates the use of foldable advertising displays in which the major components may be shipped in a flattened position and assembled by the retail merchant. The base of the Finfrock device is assembled by holding the article shown in FIG. 4 along the provided score lines and securing the base in a fixed arrangement using the appropriate tab and slot means provided. The relatively complex assembly required of the Finfrock device will be apparent to those of skill in the art. The Finfrock device also requires an extended rod element 12 and upper advertisement supporting wires 17 shown at FIG. 3 of the '310 patent. It will also be apparent that the Finfrock design requires support on a counter top 13 thus reducing available space for other merchandise to be sold. The Finfrock patent also illustrates the instability of many prior art advertising systems, i.e. the relatively wide top compared to the narrower base results in a system which may be easily tipped or knocked over resulting in potential damage to the display itself and to nearby merchandise or persons.

The U.S. Pat. No. 3,032,905 issued to Schultz illustrates foldable display elements which are designed and shaped so as to rest on product shelving units. Although conceptually related to the present invention, the Schultz patented system is structurally dissimilar for the present design as will be appreciated in the full disclosure which follows hereinbelow.

BRIEF SUMMARY OF THE INVENTION

The invention comprises a flattened sheet of corrugated fiberboard material which has two elongated score lines factory preformed thereon so that the display insert is divided into three principal sections or zones.

A central section having no tabs formed therein is designed to fill the space between two adjacent bookshelf units. The central section is further adapted to have printed matter or decorative material applied to the exterior surface thereof.

The invention device also incorporates two outer sections formed via the two elongated score lines.

A first outer section has two shortened tab means formed therein via factory applied cut and score lines such that the tab means in their extended positions lie in parallel to the central section of the display insert.

A second outer section has longer flap means formed as a part thereof and designed so as to lie, in the extended position, perpendicular to the extended tab means of the first outer section.

Both the tab means of the first outer section and the flap means of the second outer section are formed so as to have groove elements at the outer extended edges thereof. The tab means and the flap means are positioned in their respective sections so that the groove elements interlock to give stability to the overall device while using a system which is very easy to assemble and install into a desired bookshelf structure.

BRIEF DESCRIPTION OF THE DRAWING FIGURES

FULL DESCRIPTION OF THE PREFERRED EMBODIMENT

Figure 1:
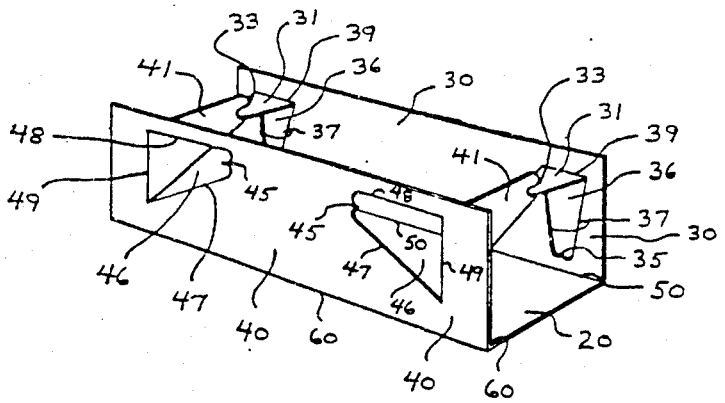
FIG. 1 is an isometric view of the display insert in its assembled position with the decorative central section in a face down position.
Figure 2:
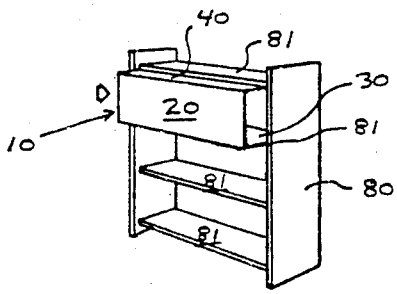
FIG. 2 illustrates the method of positioning the assembled display insert into its desired position between two shelving units.

Reference in detail is now made to the drawing FIGS. 1 and 2 in which like component parts are designated by the same numerals.

As shown in the assembled position of FIG. 1, the display insert has three main sections 20, 30 and 40 formed thereon by factory applied score lines running the entire length of the device. The elongated section-forming score lines are indicated at numerals 50 and 60 of FIG. 1.

The outer portion of central section 20, shown face down in FIG. 1, is utilized for the intended display or advertising purposes.

As shown in FIG. 1, the score lines 50 and 60 allow the outer sections 30 and 40 to be folded inwardly ninety degrees to the intended assembly position.

As further shown in FIG. 1, the first outer section 30 has shortened tab elements 31 formed therein by way of cut through wall portions 37. It will thus be appreciated that tab elements 31 are bendable by way of score lines 39 also formed in the first outer section 30. Upon bending of the tab means 31, apertures 36 are formed in the first outer section 30.

It is to be further appreciated that grooves 33 are formed in the ends of the tab elements 31 for purposes to be further explained. As shown in FIG. 1, the grooves 33 correspond in size to the elevated portion 35 shown at the lower region of aperture 36.

A second outer section 40 of the display insert device is further shown in FIG. 1. The second outer section 40 has enlarged flap means 41 formed as a part thereof by way of cut through portions 47, 48 and 45. It will further be appreciated that the two enlarged flap means 41 pivot about the axes formed by score lines positioned at numerals 49 and that the flap means 41 have grooves formed on the ends thereof for a mating relationship with the grooves 33 of tab elements 31.

Thus, as shown in the assembled position of FIG. 1, the flap means 41 and the tab means 31 are joined at their grooved ends such that the outer sections 30 and 40 are assembled in parallel relation to each other with both outer sections 30 and 40 being held perpendicular to the central section 20 in the assembled position.

As shown in FIG. 1, score line means 49 of the flaps 41 are formed so as to lie in a plane which is perpendicular to the plane of score line means 39 of tabs 31 when the display insert is in the assembled position. Such arrangement allows the interfitting of the grooved ends of the tab means 31 and flap means 41.

The display insert may thus be shipped in a flat or knockdown position and be readily assembled as shown in FIG. 1.

As shown in FIG. 2, the assembled device is then simply slid between two adjacent shelves 81 of a bookshelf 80. The outer visible portion of central section 20 may have printed, decorative, or advertising matter factory applied thereto utilizing known printing technology. It is contemplated, for example, that local school logos would be factory applied to the central section 20 to enhance product sales. Other advertising material or such designations as Children's Toys could also be factory applied to the visible portion of central section 20 as desired.

It will be thus be appreciated by those of skill in the art that an easy to assemble product enhancing display is provided which is safe and durable in its intended use. As shown, the central section 20 will remain in its intended position in bookshelf 80 since the outer sections 30 and 40 are held in parallel relation to each other by way of the interlocking tab means 31 and flap means 41.

Importantly, the display insert of the present invention does not require the use of valuable floor or counter top space of a retail merchant. Instead, it is specifically and uniquely designed to be positioned in a shelving location which would not normally be used by the retail merchant.

In the event that the bookshelf 80 would be sold in a knockdown position, the printing of various state or school designations could be more readily factory accomplished by simply changing the printed matter on the decorative insert 10 without the need to change printed matter on the bookshelf 80.

While corrugated fiberboard is the preferred material of the present invention, it will of course be appreciated that the inventive concepts disclosed herein could be readily applied using other deformable materials such as plastics, metals, etc. and it is intended that such alternate uses be considered as within the score of the invention.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A decorative insert means (10) for use in a bookshelf (80) or related unit wherein said decorative insert comprises:

an elongated corrugated fiberboard element (10) having three main sections (20, 30, 40) formed thereon by way of score line means (50, 60), said three main sections comprising a first outer section means (30), a second outer section means (40) and a central section means (20), wherein a first elongated score line means (50) is formed between said first outer section means (30) and said central section means (20) and wherein a second elongated score line means (60) is formed between said second outer section means (40) and said central section means (20), means whereby said first and second outer section means (30, 40) may be folded to a position parallel to each other and perpendicular to said central section means (20), tab means (31) being formed in the first outer section means (30), said tab means (31) being foldable through at least ninety degrees upon assembly of the decorative insert, flap means (41) being formed in the second outer section means (40), said flap means (41) being foldable through at least ninety degrees upon assembly of the decorative insert, said tab means (31) and said flap means (41) having means (33) formed on the ends thereof for interlocking with each other to provide means whereby the parallel relationship of said first and second outer section means (30, 40) is maintained upon assembly of the device, wherein said central section means (20) has a smooth outer surface to which decorative or promotional printed material may be applied, said decorative insert means (10) being sized so as to securely fit between adjacent shelves (81) of a bookshelf unit (80)(.), wherein said tab means (31) in said first outer section means (30) are formed via cut portions (37, 35) and by score line means (39) being parallel to the elongated score line means (50, 60) of the unit, wherein said flap means (41) in said second outer section means (40) are formed via cut portions (47, 48, 45) and by score line means (49) being perpendicular to the elongated score line means (50, 60) of the unit, wherein said interlocking means (33) comprises groove means formed in the ends of each of said tab means (31) and said flap means (41), said groove means (33) being interfitted upon assembly of the device, wherein said tab means (31) are in perpendicular relationship to said flap means (41) upon assembly of the device, wherein said first outer section means (30) includes at least two of said tab means (31), wherein said second outer section means (40) includes at least two of said flap means (41), wherein, upon assembly of the device, said first outer section means (30) has an aperture means (36) formed therein corresponding to the shape of said tab means (31), said aperture means (36) having tapered side walls (37) and a lower elevated wall portion (35) corresponding to the groove means (33) formed in said tab means (31), wherein, upon assembly of the device, said second outer section means (40) has an aperture means (46) formed therein corresponding to the shape of said flap means (41) said aperture means (46) having at least one tapered side wall (47) and an internally extended wall portion (45) corresponding to the groove means formed in said flap means (41).

* * * * *